US005531547A

United States Patent [19]

Shimada

[11] Patent Number: 5,531,547

[45] Date of Patent: Jul. 2, 1996

[54] REINFORCED EARTH CONSTRUCTION

[75] Inventor: Shunsuke Shimada, Tokyo, Japan

[73] Assignee: Kyokado Engineering Co., Ltd., Tokyo, Japan

[21] Appl. No.: 320,961

[22] Filed: Oct. 12, 1994

[30] Foreign Application Priority Data

Oct. 20, 1993 [JP] Japan ..... 5-262343

[51] Int. Cl.[6] ..... E02D 5/00

[52] U.S. Cl. ..... 405/262; 405/284

[58] Field of Search ..... 405/258, 262, 405/284, 286, 287, 275

[56] References Cited

U.S. PATENT DOCUMENTS

| | | | |
|---|---|---|---|
| 4,117,686 | 10/1978 | Hilfiker et al. . | |
| 4,329,089 | 5/1982 | Hilfiker et al. | 405/287 |
| 4,343,572 | 8/1982 | Hilfiker | 405/284 |
| 4,391,557 | 7/1983 | Hilfiker et al. | 405/287 |
| 4,643,618 | 2/1987 | Hilfiker et al. | 405/287 |
| 4,659,261 | 4/1987 | Chiaves | 405/286 |
| 4,856,939 | 8/1989 | Hilfiker | 405/284 |
| 4,961,673 | 10/1990 | Pagano et al. | 405/287 |
| 5,156,496 | 10/1992 | Vidal et al. | 405/262 |
| 5,259,704 | 11/1993 | Orgorchock | 405/262 |

FOREIGN PATENT DOCUMENTS

| | | | |
|---|---|---|---|
| 0197000 | 3/1986 | European Pat. Off. | E02D 17/20 |
| 0574233A1 | 12/1993 | European Pat. Off. | E02D 29/02 |
| 2140488 | 11/1984 | United Kingdom | E02B 3/12 |
| 2212532 | 7/1989 | United Kingdom | E02D 29/02 |

*Primary Examiner*—Frank S. Tsay
*Attorney, Agent, or Firm*—James H. Tilberry

[57] ABSTRACT

A revetment formed from orthogonally arrayed reinforcing rods secured together. A membrane is secured to the back side of the reinforcing rods to retain backfill compacted behind the revetment, or a vegetation ground cover may be planted on the exposed surface of the revetment to prevent erosion. Horizontal anchor rods secured to the revetment rods extend rearwardly therefrom and are embedded in the backfill to stabilize the revetment. Adjustable anchor rods allow tension to be selectively applied to the revetment for the purpose of alignment.

18 Claims, 10 Drawing Sheets

REINFORCED EARTH CONSTRUCTION

BACKGROUND OF THE INVENTION

1. Field of Invention

The field of invention relates to the art of revetments for protecting earthen banks from erosion and/or collapse.

2. Description of Related Art

A prior art revetment is shown in FIG. 7, in which reference numerals 18 designate concrete wall panels vertically stacked to form a revetment, the numeral 19 designates backfill banked behind the wall panels 18, and the numerals 20 designate wall-anchoring members connected to each wall panel 18 and deeply inserted into the earth retained by the wall panels 18.

There have been problems with such prior art revetments. The concrete panels 18 are extremely heavy, which makes the handling thereof, such as transportation and setting up, very difficult.

There have also been problems with wall deformation and/or shifting due to earth back pressure caused by settling and compacting backfill layer 19 by rolling.

SUMMARY OF THE INVENTION

A preferred embodiment of the subject invention comprises a reinforcing grid as a surface material which is assembled from a plurality of vertical and horizontal reinforcing rods into a lattice to form a rise portion. A leg portion or portions is formed by bending at least either the upper and lower ends of the rise portion at substantially right angles to the rise to extend inwardly into an earthen bank.

In another preferred embodiment of the invention, the upper and lower leg portions are fixed to each other with a convex portion formed therebetween.

In yet another preferred embodiment of the invention, a connecting rod for connecting the upper and lower reinforcing leg portions to each other is inserted into a space defined by the convex portion and the vertical reinforcement of the upper reinforcing grid.

In still another preferred embodiment of the invention, the rise portion of the surface material is curved in an arcuate shape.

OBJECTS OF THE INVENTION

It is therefore among the objects of the present invention to provide revetment means that solve the above-discussed prior art problems.

Another object of the present invention is to provide revetment construction which can prevent the shifting, deformation, or overhanging of an overall revetment wall body, which can be beautified by means of shrubbery and ground cover, which is simple in construction and easy to assemble, and which is also functionally very effective.

Other objects of the invention include the provision of lightweight L-shaped or channel-shaped reinforcing grids; surface grids that are extremely lightweight, freestanding and easily transported and set up; and U-shaped risers which enable upper and lower grids to be easily connected, which resist surface pressure, and which integrate the grids with the banking layers to improve the strength of the revetment.

The foregoing and other objects, features, and advantages of the invention will become apparent from the detailed description set forth hereinafter when considered in conjunction with the accompanying drawings.

BRIEF DESCRIPTION OF THE DRAWINGS

FIG. 2(*b*) is a fragmentary perspective view of another preferred embodiment of the invention;

FIG. 2(*c*) is a fragmentary elevational view of yet another preferred embodiment of the invention;

FIG. 3(*b*) is a side elevational view in section of an arcuately convex riser portion of a preferred embodiment of the invention;

FIG. 3(*c*) is a fragmentary sectional side elevational view of another means for interconnecting vertical and horizontal rods forming the riser portion of the preferred embodiment of the invention shown in FIG. 1;

FIG. 3(*d*) is a side elevational view in section of an arcuately convex channel-shaped riser portion of a preferred embodiment of the invention;

FIG. 4(*b*) is a fragmentary side elevational view of another means for adjusting the tension in a revetment anchoring rod in accordance with a preferred embodiment of the invention;

FIG. 4(*c*) is a fragmentary side elevational view of a riser rod comprising an element of a revetment riser in accordance with a preferred embodiment of the invention;

FIG. 4(*d*) is a fragmentary side elevational view of a revetment anchoring rod in accordance with a preferred embodiment of the invention;

FIG. 4(*e*) is a fragmentary side elevational view of an anchoring rod, such as shown in FIG. 4(*d*), connected to a riser leg in accordance with a preferred embodiment of the invention;

FIG. 4(*f*) is a fragmentary side elevational view of another form of anchoring rod in accordance with a preferred embodiment of the invention;

FIG. 4(*g*) is a fragmentary side elevational view in section of a revetment riser showing means to connect the riser legs to anchoring rods in accordance with a preferred embodiment of the invention;

FIG. 5(*b*) is a fragmentary side elevational view in section of a revetment riser with reinforcing horizontal cross rods in accordance with a preferred embodiment of the invention;

FIG. 5(*c*) is a fragmentary side elevational view in section of yet another configuration of a revetment riser configuration in accordance with another preferred embodiment of the invention;

FIG. 5(*d*) is a fragmentary side elevational view in section of another means for connecting an anchor rod to a revetment riser in accordance with yet another preferred embodiment of the invention;

FIG. 5(*e*) is a fragmentary side elevational view in section of still another means for connecting an anchor rod to a revetment riser in accordance with yet another preferred embodiment of the invention;

FIG. 5(*f*) is a fragmentary side elevational view section of another type of anchor means for securing a revetment riser in accordance with a preferred embodiment of the invention;

FIG. 6(*b*) is a schematic side elevational view section of the second step in the construction of a revetment in accordance with a preferred embodiment of the invention;

FIG. 6(*c*) is a schematic side elevational view in section of the third step in the construction of a revetment in accordance with a preferred embodiment of the invention;

FIG. 6(*d*) is a schematic side elevational view in section of the fourth step in the construction of a revetment in accordance with a preferred embodiment of the invention.

DESCRIPTION OF THE PREFERRED EMBODIMENTS OF THE INVENTION

Figure 1:
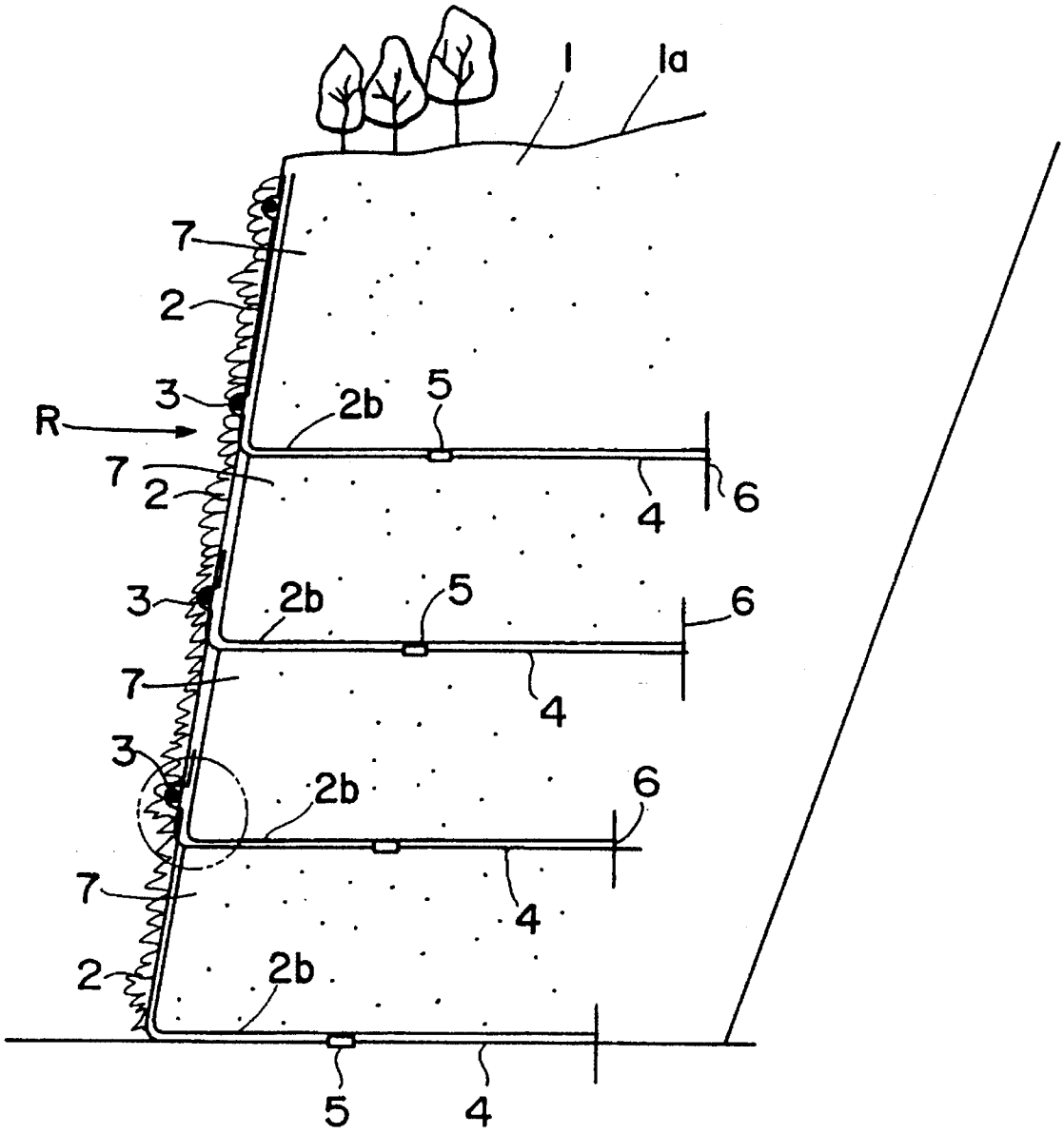
FIG. 1 is an elevational side view in section of a preferred embodiment of the present invention.

FIG. 1 shows a reinforced earth revetment R as a preferred embodiment of the present invention. In the figure, reference numeral 1 designates backfill banked to a predetermined height 1A and compacted by rolling. A riser 2 comprises a reinforcing grid constructed to provide both vertical and lateral reinforcement for the backfill 1 and to prevent the backfill from collapsing. Horizontal connecting rods 3 are installed to overlap and interconnect portions of the vertical rods 2. Horizontal anchor rods 4 are deeply embedded in the backfill 1 to secure the riser rods 2 and 3. Connecting members 5 secure anchor rods 4 to leg portions 2*b*. Anchor bearing plates 6 are secured to the remote ends of anchor rods 4 so as to firmly secure the anchor rods 4 in backfill 1. Membrane sheets 7A are secured to the inside surface of the revetment R as shown in FIGS. 6(*a*)–6(*d*), or, in lieu thereof, a vegetation mat 7 may be planted on the exposed surface of backfill 1 to prevent erosion and/or collapse of the bank and to improve its appearance, as shown in FIG. 1.

Figure 2A:
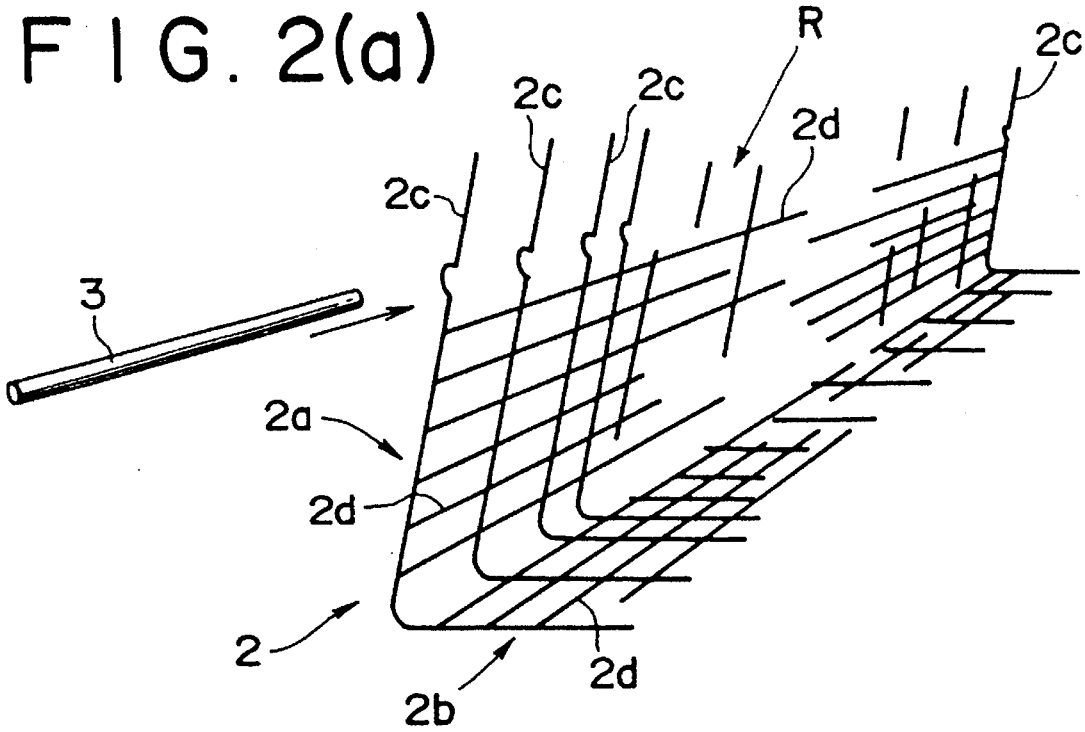
FIG. 2(*a*) is a fragmentary perspective view showing a preferred embodiment of the invention.
Figure 2B:
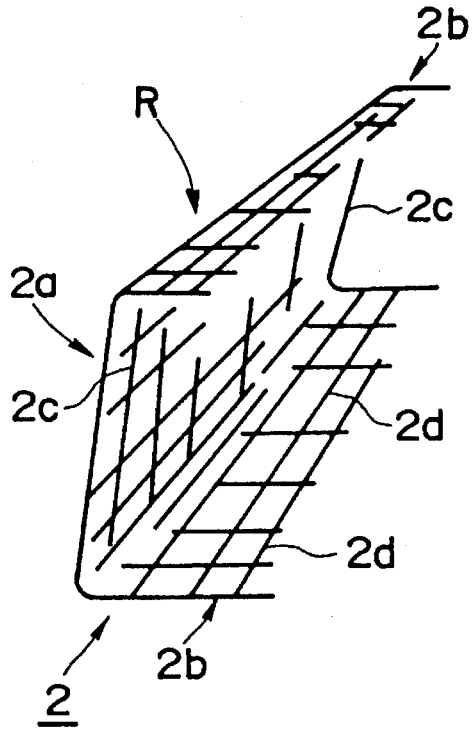
Figure 2C:
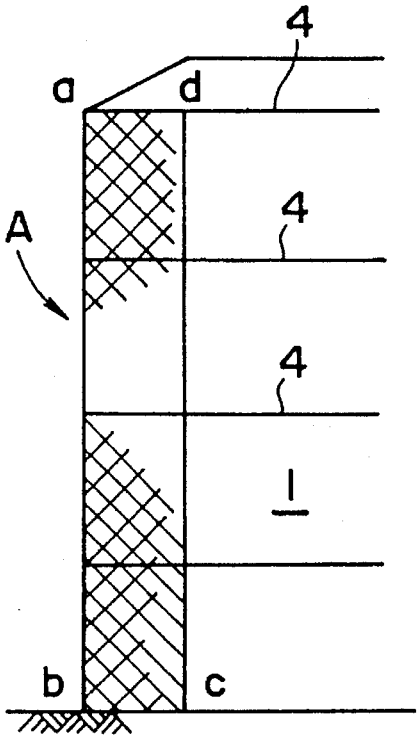
Figure 3A:
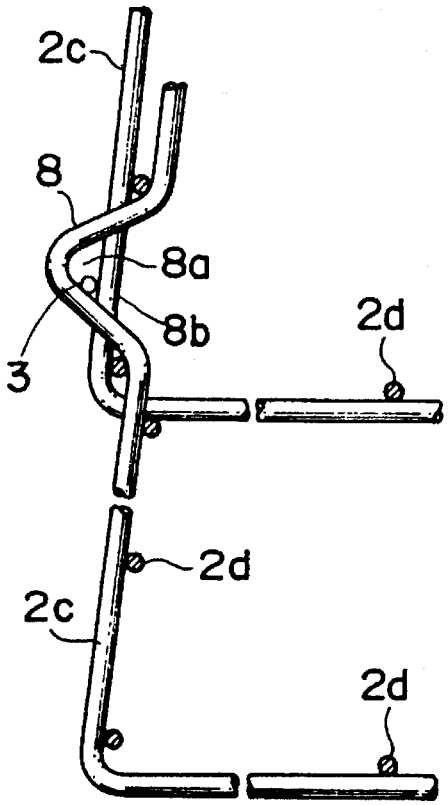
FIG. 3(*a*) is a fragmentary sectional side elevational view of one means for interconnecting vertical and horizontal rods forming the riser portion of the preferred embodiment of the invention shown in FIG. 1.
Figure 3C:
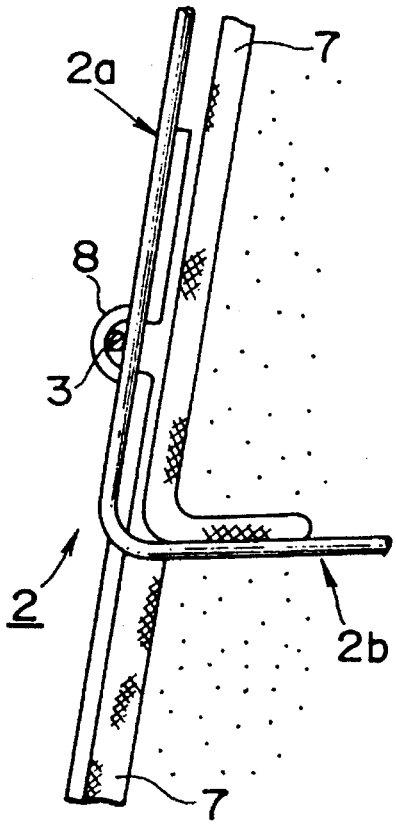
Figure 3B:
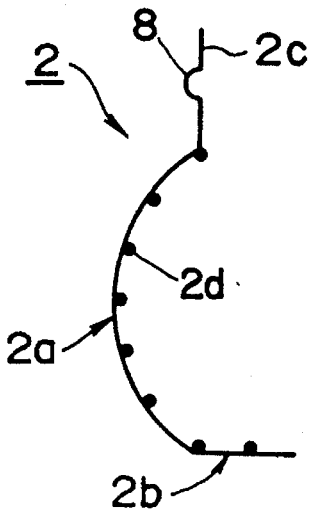
Figure 3D:
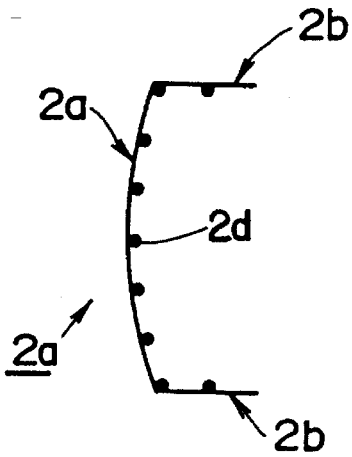
Figure 4A:
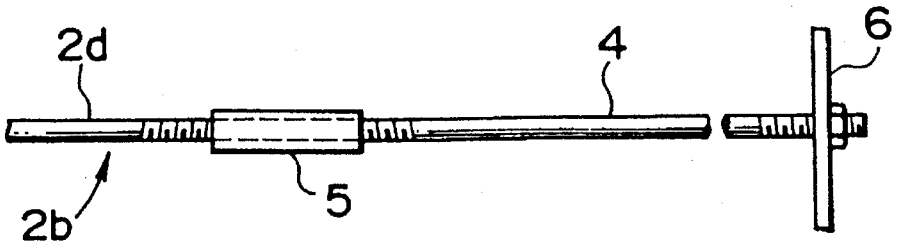
FIG. 4(*a*) is a fragmentary side elevational view of means for adjusting the tension in a revetment anchoring rod in accordance with a preferred embodiment of the invention.
Figure 4B:
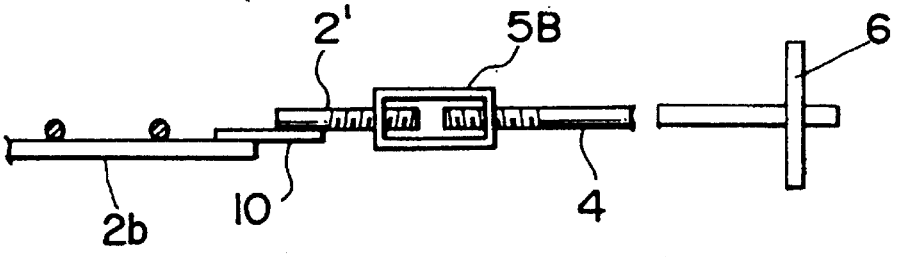
Figure 4C:
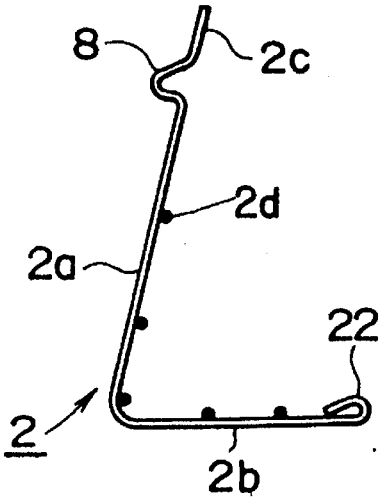
Figure 4D:
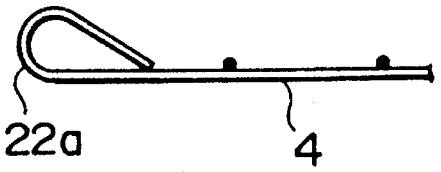
Figure 4E:
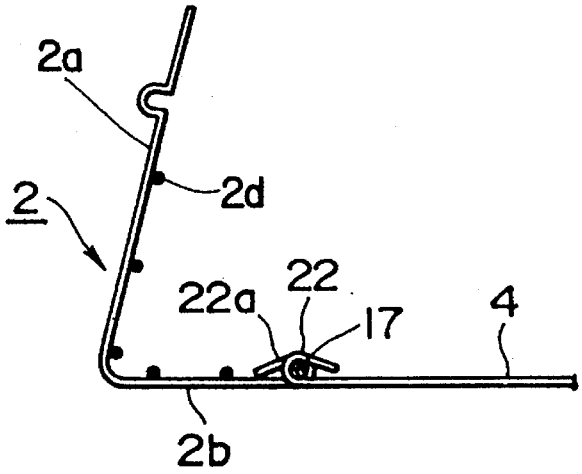
Figure 4F:
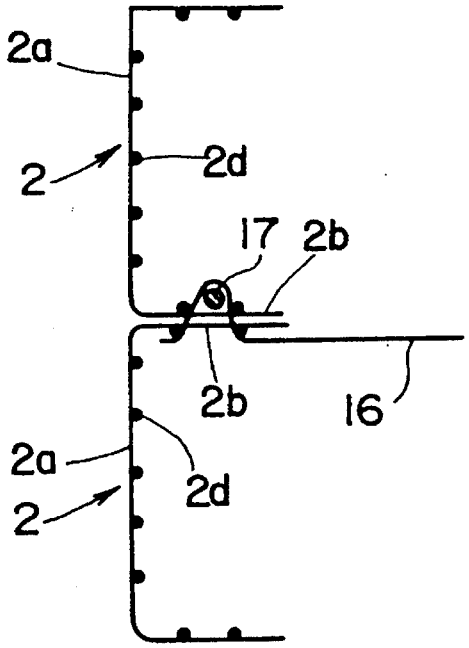
Figure 4G:
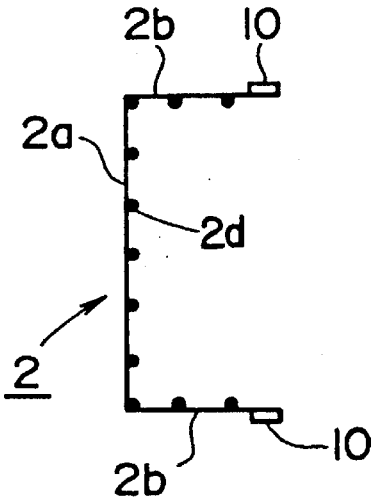
Figure 5A:
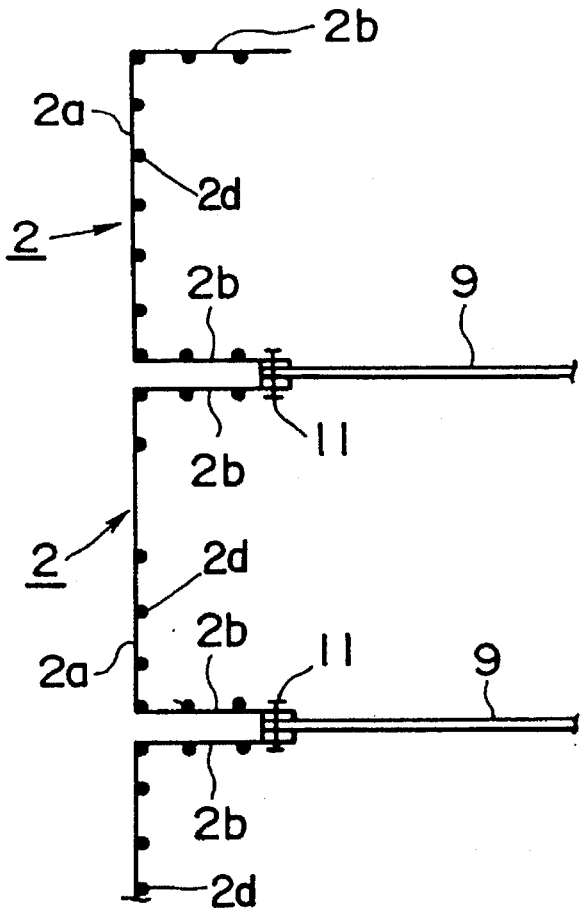
FIG. 5(*a*) is a fragmentary side elevational view in section of a revetment riser showing yet another means for connecting anchor rods to a revetment riser in accordance with a preferred embodiment of the invention.
Figure 5B:
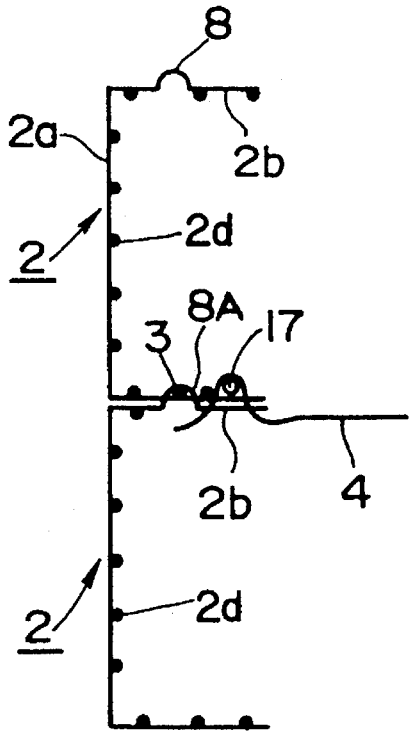
Figure 5C:
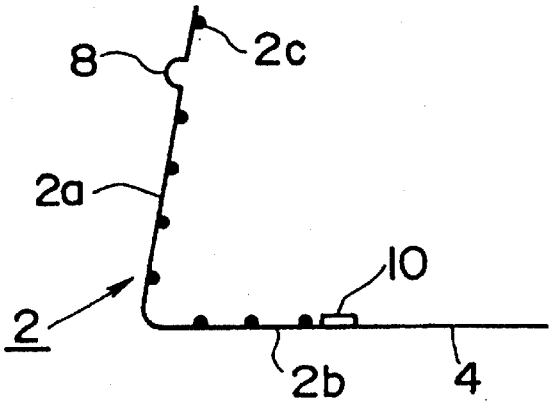
Figure 5D:
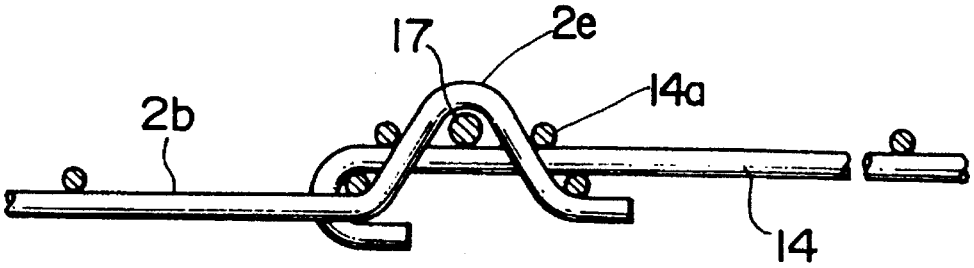
Figure 5E:
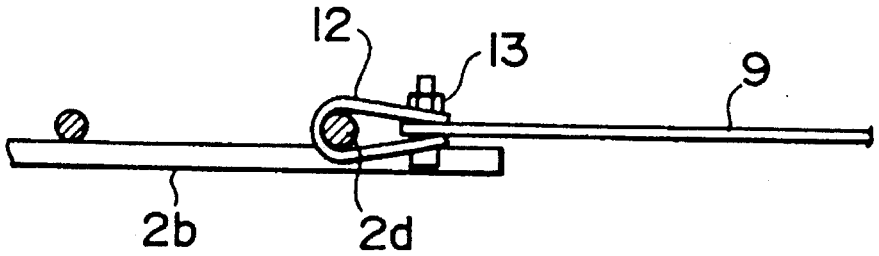
Figure 5F:
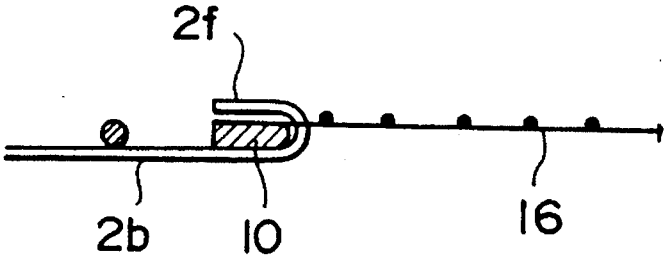
Figure 6A:
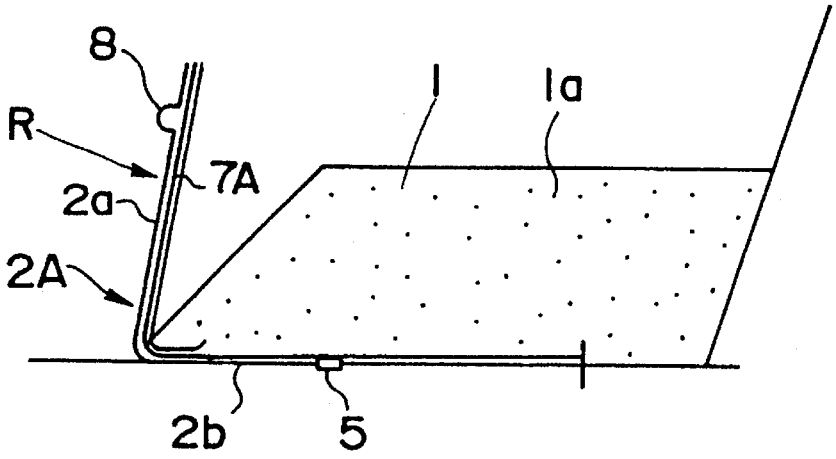
FIG. 6(*a*) is a schematic side elevational view in section of the first step in the construction of a revetment in accordance with a preferred embodiment of the invention.
Figure 6B:
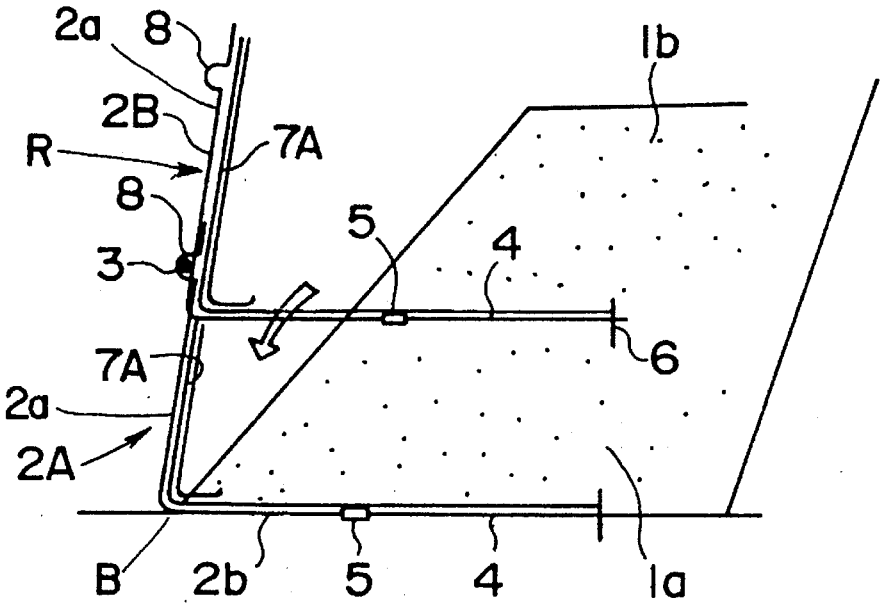
Figure 6C:
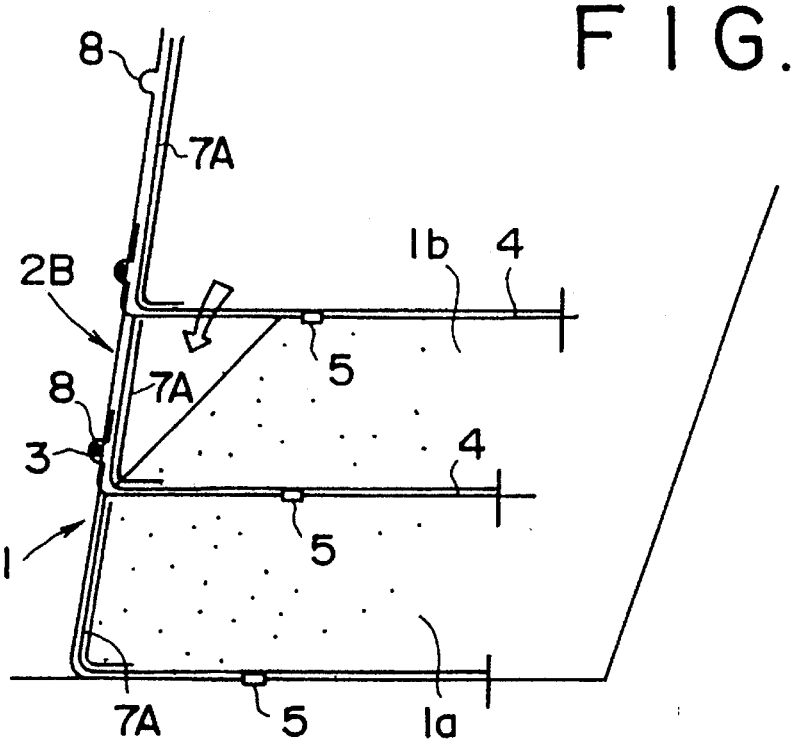
Figure 6D:
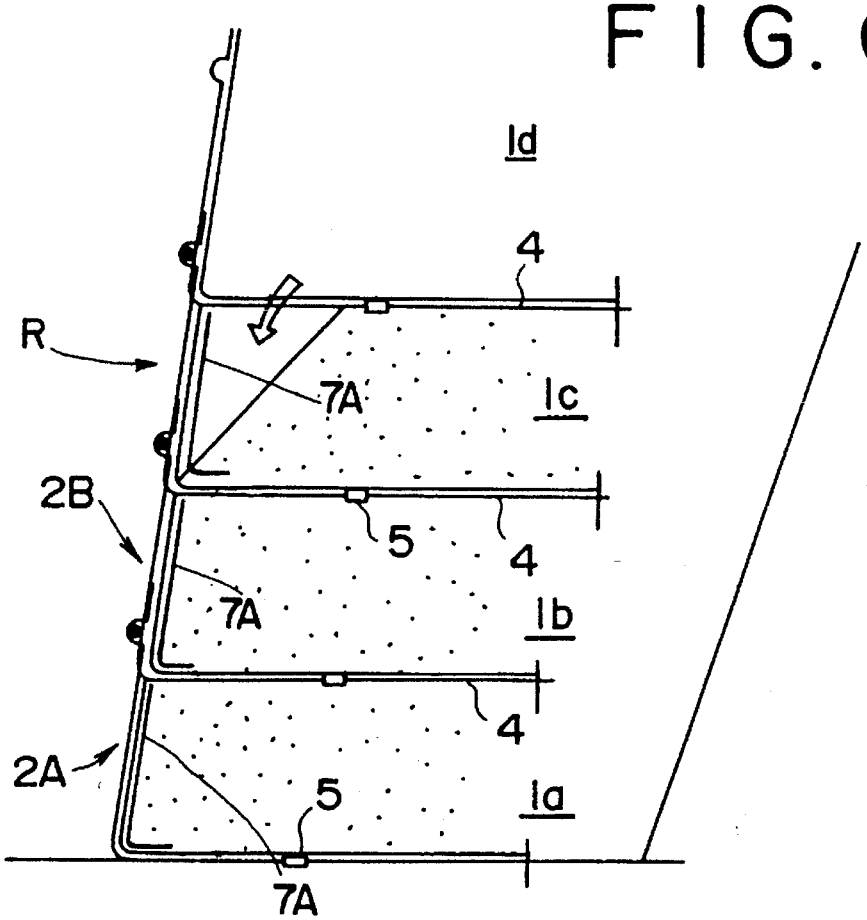
Figure 7:
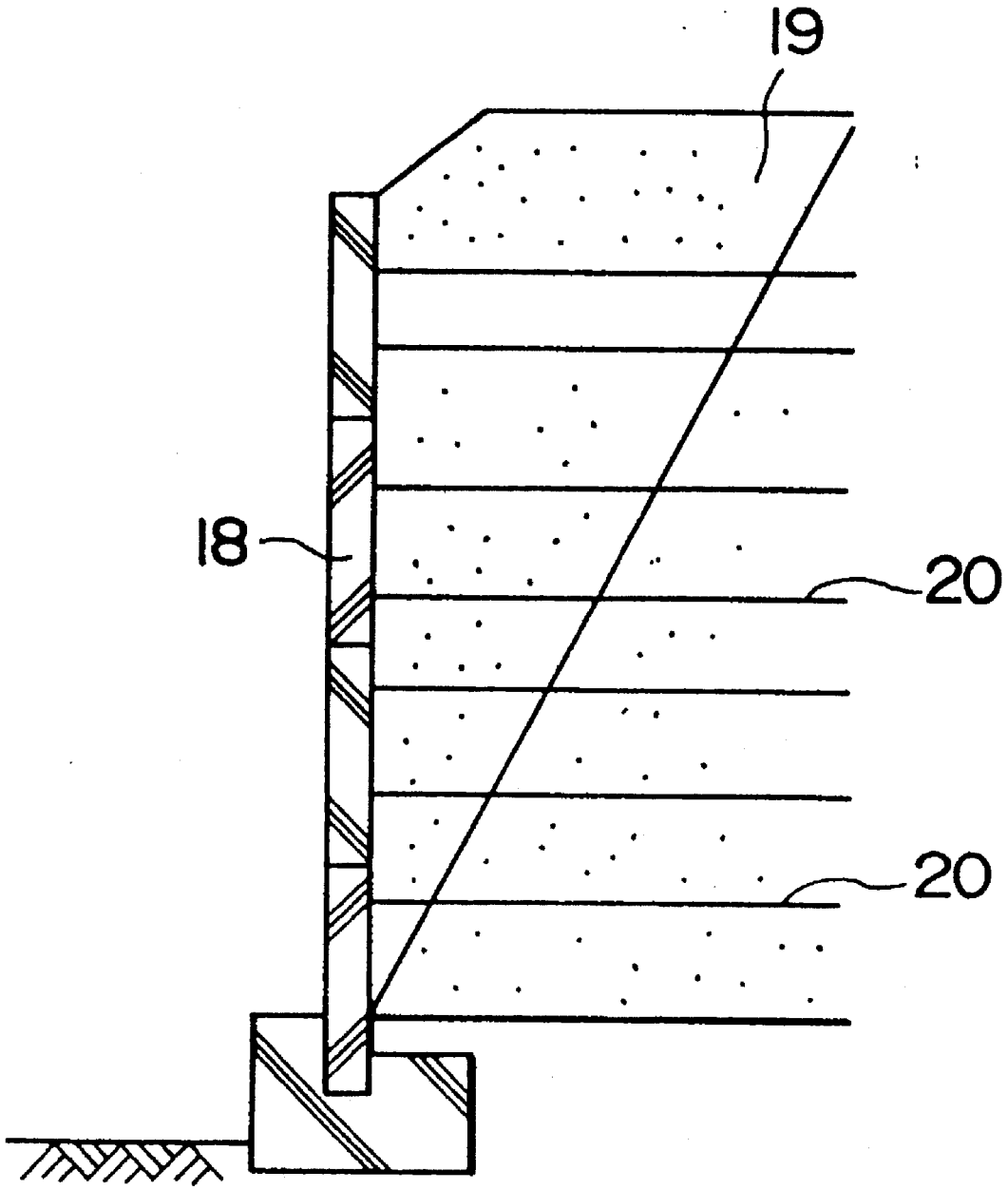
FIG. 7 (PRIOR ART)
FIG. 7 is a fragmentary side elevational view in section of a prior art revetment.

The revetments R as shown in FIGS. 2(*a*) and 2(*b*) are integrally composed of riser portions 2*a* and leg portions 2*b* formed by bending the upper and/or the lower ends of the risers 2*a* which are embedded horizontally in the backfill 1.

Both the riser portions 2*a* and the leg portions 2*b* of the revetment R are formed by arranging a plurality of vertical and horizontal reinforcement rods 2*c*, 2*d* into a lattice so as to approximately cross at right angles, while welding each intersecting portion between the vertical reinforcement rod 2*c* and the horizontal reinforcement 2*d*. The revetment R can be L-shaped, as shown in FIG. 2(*a*) or channel-shaped, as shown in FIG. 2(*b*). The riser portions 2*a* and the leg portions 2*b* are formed by bending each vertical reinforcement rod 2*c* into an L-shape. The revetment R shown in FIG. 2(*b*) is constituted in a channel shape by bending both upper and lower ends of the vertical reinforcement rods 2*c* to form leg portions 2*b*. The vertical and horizontal reinforcements 2*c*, 2*d* are so arranged in a lattice intersecting at right angles in order to effectively resist against earth pressure without deformation even though the earth pressure applies axial forces on the revetment R.

The orthogonal latticework of the revetment R has strong flexural rigidity and an excellent freestanding property. Therefore, there is no need to pack the inside of the revetment R with sandbags or the like as reinforcement. Accordingly, the revetment R is labor saving, stable, and adaptable to various conditions encountered in backfill stabilization. The backfill is restrained and blocked due to the orthogonal latticework horizontal and vertical reinforcement rods 2*c* and 2*d*. As a result, a block-like wall body A, as shown in FIG. 2(*c*), is constructed of the backfill 1, as held by the revetment R, so that the wall body A is prevented from disintegrating and sliding between the revetment reinforcement rods 2*c* and 2*d*. Since the block-like wall body A gains stability by its own weight, resulting in slight displacement, the overall reinforcement of the backfill results in a stable earthen structure.

The upper end of each of the reinforcement rods 2*c*, as shown in FIGS. 3(*a*) and 3(*c*), has an outwardly projecting convex portion 8. A space 8*a* is defined between the convex portion 8 of a lower reinforcement rod 2*c* and the straight portion 8*b* of an upper reinforcement rod 2*c*. A horizontal connecting rod 3 is inserted into the space 8*a* to inerlock the lower and upper reinforcing rods 2*c*.

Each of FIGS. 3(*b*) and 3(*d*) shows the section of an arc-shaped reinforcement rod 2*a* so formed in order that only tensile forces act on each vertical reinforcement rod 2*a* without the application of any bending force thereon. As a result, a reinforced revetment with excellent stability can be constructed by using a small number of steel rod reinforcement members.

As for each anchor rod 4, use can be made of a plain round bar, FIG. 1, a threaded rod having a bearing plate 6 attached to the inboard end, FIG. 4(*a*), a reinforcing grid 2*b* attached to the rod 4, FIG. 4(*b*), or an anchor rod 4 having a looped outboard end, FIGS. 4(*d*) and 4(*e*).

The connection between the revetment latticework and the anchor rod 4 can be simply made by connecting the anchor rod 4 to a leg portion 2*b*, depending on the type of anchor rod used. For instance, FIG. 4(*a*) shows the connection by means of a threaded sleeve-type coupling 5A. FIG. 4(*b*) shows the connection by welding a steel band 10 to the leg portion 2*b* and then welding a turnbuckle 5B to the steel band 10 to connect the anchor rod 4 to anchor plate 6.

FIG. 4(*c*) shows a revetment R provided with a loop 22 on the end of the leg portion 2*b*. FIG. 4(*d*) shows an anchor rod 4 provided with a loop 22*a* at the front end of the member. FIG. 4(*e*) shows overlapping concentric loops 22 and 22*a* interlocked with a horizontal rod 17.

FIG. 4(*f*) discloses upper and lower overlapping leg portions 2*b* secured together by weaving the front end of an anchor rod 16 into the mesh of the overlapping portions of the legs 2*b* and then inserting a connecting rod 17 between the anchor rod 16 and the overlapping legs 2*b* to interlock the legs 2*b* and the anchor rod 16.

FIG. 4(*g*) shows legs 2*b* equipped with bands of steel 10 for connecting anchor rods to the revetment R, such as by welding.

In FIG. 5(*a*) legs 2*b* and anchor rods 9 are connected to each other by a connecting bolt 11.

In FIG. 5(*b*), the convex portion 8A, similar to convex portion 8 of FIG. 3(*a*), is included as a portion of leg 2*b* to receive an interlocking rod 3 to secure together upper and lower leg portions 2*b*. As in FIG. 4(*f*), a connecting rod 17 secures the anchor rod to the legs 2*b*.

FIG. 5(*c*) shows an L-shaped riser 2 in which the leg 2*b* is provided with a steel band 10 for connecting the anchor rod 4 to the revetment R, wherein the steel band is welded to the inboard end of the leg portion 2*b* and to the outboard end of the anchor rod 4..

FIG. 5(*d*) shows an anchor rod 14 provided with an anchor grid 14a, and a leg member 2*b* with a convex configured inboard end 2*e* interwoven therein. A connecting rod 17 interconnects the inboard end 2*e* of leg 2*b* with the anchor rod 14.

In FIG. 5(*e*), the anchor rod 9 is secured to revetment leg cross rod 2*d* by forming a strap 12 into a loop around cross rod 2*d* and bolting the free ends of the looped strap to the front end of anchor rod strap 9.

In FIG. 5(*f*), a grid-like anchor rod 16 is secured to a steel plate 10 and a leg member 2*b* inboard end is formed into a hook 2*f* which engages the steel plate 10.

Next will be explained a method for constructing the revetment R according to the present invention with reference to FIG. 6(*a*)–(*d*).

Step (1). The lowermost upstanding reinforcing grid 2A is positioned at the base of the revetment R and anchor rod 4 is connected to the leg portion 2*b* of the reinforcing grid 2A [see FIG. 6(*a*)], so that the revetment reinforcing grid is freestanding. Next, a sheet 7A for preventing the outflow of backfill is mounted on the inside wall surface portion 2*a* of the reinforcing grid 2A.

Step (2). Backfill 1 is bulldozed over the anchor rods 4, and then sufficiently compressed by rolling to achieve a compacted layer 1*a* [see FIG. 6(*a*)].

Step (3). Referring to FIG. 6(*b*), steps 1 and 2 are repeated to distribute another layer of backfill 1*b* on top of backfill layer 1*a*. In this case, the reinforcing grid 2A is connected to a reinforcing grid 2B set up on the upside of the reinforcing grid 2A [see FIG. 6(*b*)].

When the upper and lower upstanding reinforcing grids 2A and 2B are connected to each other, the upper end of the wall surface portion 2*a* of the reinforcing grid 2A is overlapped with the wall surface portion 2*a* of the reinforcing grid 2B immediately after the reinforcing grid 2B is set up on the banking layer 1*a*. At this time, the convex portion 8 of the reinforcing grid 2A is projected from the mesh of the wall surface portion 2*a* of the reinforcing grid 2B to the outside of the reinforcing grid, and the connecting rod 3 is inserted horizontally into the convex portion 8 from the lateral direction. See also FIGS. 3(*a*) and 3(*c*).

Since the upper end of the reinforcing grid 2A is connected to the lower end of the reinforcing grid 2B, according to the method as described above, there is no possibility that the pressure of the backfill 1*a* and 1*b* will force the revetment to pivotally shift counterclockwise about its base B, causing the revetment to become unstable.

Step (4). Thereafter, steps 1 and 2 are repeated as often as necessary until the desired height of compacted backfill has been placed securely behind the revetment R, as schematically shown in FIG. 6(*d*).

Backfill can be made of a lightweight banking material or improved soil mixed with a consolidating material other than ordinary earth and sand. Foam mortar or like hardening grout having a fluidity at the time of mixing and working can also be used.

In lieu of membrane 7A, FIG. 6, vegetation ground cover may be planted on the exposed embankment between the revetment reinforcing rods, FIG. 1.

The inventive revetment can be also utilized as a levee widening process by securing the anchor rods to a solid base.

It will occur to those skilled in the art, upon reading the foregoing description of the preferred embodiments of the invention, taken in conjunction with a study of the drawings, that certain modifications may be made to the invention without departing from the intent or scope of the invention. It is intended, therefore, that the invention be construed and limited only by the appended claims.

I claim:

1. An earth retaining revetment comprising: reinforcing rods orthogonally arrayed and secured together to define a substantially vertical retaining wall frame having inner and outer frame wall surfaces; anchor rods having outboard and inboard ends, said outboard ends being secured to said retaining wall and said anchor rods extending horizontally away from said retaining wall frame inner surface for embedment in earth to be retained by said revetment, said inboard ends of said anchor rods being secured to cross member earth anchor plates; and means to individually adjust the lengths of said anchor rods, whereby vertical and horizontal alignment of said revetment may be obtained and the revetment may be tensioned and stabilized as required by individually adjusting the lengths of said anchor rods.

2. The earth retaining revetment of claim 1, including interposing membrane sheeting adjacent said vertical retaining wall frame inner surfaces to prevent erosion.

3. The earth retaining revetment of claim 1, wherein said revetment is inclined toward the earth to be retained.

4. The earth retaining revetment of claim 1, wherein said wall frame comprises a first horizontal row of L-shaped rods having horizontal legs and substantially vertical legs, said horizontal and said substantially vertical legs being substantially the same length, and a second row of said L-shaped rods substantially vertically stacked on and secured to said substantially vertical legs of said first row, said horizontal legs being directed inwardly from the said inner wall frame surface toward the earth to be retained.

5. The earth retaining revetment of claim 4, wherein said outboard ends of said anchor rods are secured to said horizontal legs of said L-shaped rods, and said inboard ends of said anchor rods and said anchor plates are embedded in the earth to be retained.

6. The earth retaining revetment of claim 4, wherein each of said substantially vertical legs includes an outwardly projecting convex portion overlapping and extending outwardly beyond the next adjacent higher L-shaped leg, and a horizontal connecting rod passing through said convex portions of said substantially vertical legs adjacent the inner edges of said convex portions and adjacent the outer edges of said adjacent higher L-shaped legs.

7. The earth retaining revetment of claim 4, wherein said substantially vertical portions of said L-shaped rods are convex and define outer wall surfaces.

8. The earth retaining revetment of claim 4, wherein said inboard ends of said horizontal legs are formed into loops and said outboard ends of said anchor rods are formed into loops, said loops of said horizontal legs and said loops of said anchor rods being concentrically aligned and secured together with transverse rods threaded through said loops.

9. The earth retaining revetment of claim 4, wherein the ends of said legs are crimped to form inverted V's thereon and the outboard ends of said anchor rods are crimped to form hooks thereon, said inverted V ends and said hook ends overlapping to form spaces therebetween, and wherein cross rods in said spaces transversely interlock said legs and said anchor rods.

10. The earth retaining revetment of claim 4, wherein the ends of said legs have at least one cross rod secured thereto and loop members about said cross rods are bolted to the outboard ends of said anchor rods.

11. The earth retaining revetment of claim 4, wherein the ends of said legs are looped and a cross bar is received within and secured to said loops and to the outboard ends of said anchor secured to said cross bar.

12. The earth retaining revetment of claim 1, wherein said wall frame comprises a first horizontal row of channel-shaped rods, each having a substantially vertical portion with lower and upper ends; a lower horizontal leg extending inwardly from said lower end of said substantially vertical portion away from said inner wall surface; an upper horizontal leg extending inwardly from said upper end of said substantially vertical portion away from said inner wall surface; a second row of channel shaped rods substantially vertically stacked on said first horizontal row of channel-shaped rods, each having a substantially vertical portion with lower and upper ends; a lower horizontal leg extending inwardly from said lower end of said substantially vertical portion away from said inner wall surface; and an upper horizontal leg extending inwardly from said upper end of said substantially vertical portion inwardly away from said upper end of said substantially vertical portion and away from said inner wall surface; said outboard ends of said anchor rods interconnecting said upper legs of said first horizontal row of channel-shaped rods to said lower legs of said second row of channel-shaped rods.

13. The earth retaining revetment of claim 12, wherein adjacent said lower legs are secured together with orthogonal cross member rods to form a lower mesh, said upper legs are secured together with orthogonal cross member rods to form an upper mesh, and adjacent said lower and upper meshes are secured together and to said anchor rods by said outboard ends of said anchor rods which are woven through said lower and upper meshes.

14. The earth retaining revetment of claim 12, wherein adjacent said lower and upper legs are secured together and to said anchor rods by clevis and pin means.

15. The method of forming an orthogonal steel rod earth retaining revetment, comprising the steps of:

(a) aligning a first horizontal row of spaced apart steel rod L-shaped members, each with a horizontal leg and a substantially vertical leg, said horizontal legs extending rearwardly into the space to be occupied by revetment-retained earth;

(b) securing said first horizontal row of L-shaped member legs to horizontal transversely extending rod members to form an orthogonal steel rod mesh;

(c) securing first horizontal row anchor rods to said first row horizontal legs;

(d) backfilling a first load of earth on said first horizontal row horizontal legs and on said first anchor rods;

(e) compacting said first load of backfilled earth;

(f) securing a second horizontal row of spaced-apart steel rod L-shaped members to the upper portions of said first horizontal row vertical legs;

(g) securing said second horizontal row of L-shaped members to transversely extending rod members to form an orthogonal steel rod mesh;

(h) securing second horizontal row anchor rods to said second row horizontal legs;

(i) backfilling a second load of earth on said second horizontal row horizontal legs and on said second horizontal row anchor rods;

(j) compacting said second load of backfilled earth; and (k) repeating steps (a) through (j) until a predetermined height of backfilled and compacted earth has been attained and secured by said orthogonal steel rod earth-retaining revetment.

16. The method of claim 15, including the step of interposing membrane sheeting between said earth retaining revetment and said backfilled earth.

17. The method of forming an orthogonal steel rod earth retaining revetment comprising the steps of:

(a) aligning a first horizontal row of spaced apart steel rod channel-shaped members, each with an upper horizontal portion, a lower horizontal portion spaced apart from said upper horizontal portions, a substantially vertical intermediate portion connecting said upper and lower portions, said upper and lower horizontal portions extending rearwardly into the space to be occupied by revetment-retained earth;

(b) securing said channel-shaped members to horizontal transversely extending rod members to form an orthogonal channel-shaped steel rod mesh;

(c) securing first horizontal row anchor rods to said first horizontal row channel-shaped member lower horizontal portions;

(d) backfilling a first load of earth on said first horizontal row lower horizontal portions and on said first horizontal row anchor rods;

(e) compacting said first load of backfilled earth;

(f) securing a second row horizontal orthogonal channel-shaped steel rod mesh to said first horizontal row upper horizontal portions;

(g) securing second horizontal row anchor rods to said second horizontal row channel-shaped steel rod mesh;

(h) sheathing said second horizontal row channel-shaped steel rod mesh with earth-retaining sheet material;

(i) backfilling a second load of earth on said second horizontal row lower horizontal portions and on said second horizontal row of anchor rods;

(j) compacting said second load of backfilled earth; and (k) repeating steps (a) through (j) until a predetermined height of backfilled and compacted earth has been attained and secured by said orthogonal steel rod earth-retaining revetment.

18. The method of claim 17, including the step of interposing membrane sheeting adjacent said vertical retaining wall frame inner surface to prevent erosion.

* * * * *